US005944070A

United States Patent [19]

Schmidt et al.

[11] Patent Number: 5,944,070

[45] Date of Patent: Aug. 31, 1999

[54] EMPTYING DEVICE FOR BULK BAGS AND USE THEREOF

[75] Inventors: Manfred Schmidt, Gelnhausen; Jürgen Ohlemacher, Maintal; Horst Parbel, Gelnhausen; Johannes Ehrlich, Alzenau, all of Germany

[73] Assignee: Degussa-Hüls Aktiengesellschaft, Frankfurt am Main, Germany

[21] Appl. No.: 08/948,461

[22] Filed: Oct. 10, 1997

[30] Foreign Application Priority Data

Oct. 11, 1996 [DE] Germany ..... 196 41 982

[51] Int. Cl.[6] ..... B65B 1/04

[52] U.S. Cl. ..... 141/114; 222/105; 222/181.2

[58] Field of Search ..... 141/114, 313, 141/65; 222/105, 181.2, 529; 414/403, 404, 415, 787

[56] References Cited

U.S. PATENT DOCUMENTS

| | | | |
|---|---|---|---|
| 4,442,956 | 4/1984 | Carlsson | 232/185 |
| 4,946,071 | 8/1990 | Poulton | 222/181.3 |
| 4,966,311 | 10/1990 | Taylor | 222/105 |
| 4,998,991 | 3/1991 | Poulton | 222/181 |
| 5,033,706 | 7/1991 | Poulton | 248/149 |

FOREIGN PATENT DOCUMENTS

| | | |
|---|---|---|
| 0562748A1 | 9/1993 | European Pat. Off. . |
| 0637552 | 2/1995 | European Pat. Off. . |
| 2250016 | 5/1992 | United Kingdom . |

*Primary Examiner*—Steven O. Douglas
*Attorney, Agent, or Firm*—Smith, Gambrell & Russell; Beveridge, DeGrandi, Weilacher & Young Intellectual Property Group

[57] ABSTRACT

An emptying device for bulk bags having an inner and outer sack in which disturbances during emptying and contact with the bulk material are avoided. The device includes a holding device for the bulk bag, a double tube device arranged centrally beneath the holding device and having an inner tube, an outer tube arranged around the inner tube with an outlet fitted to its lower edge, and a closing ring which can be raised and lowered for closing the upper end of the annular gap formed by the two tubes. The device can additionally include at least one gripping device for securing the sack outlet of the inner sack, which gripping device can be moved up and down within the inner tube and can be pulled downwards by means of a pulling device operable from outside the double tube device.

16 Claims, 3 Drawing Sheets

EMPTYING DEVICE FOR BULK BAGS AND USE THEREOF

INTRODUCTION AND BACKGROUND

The present invention relates to an emptying device for bulk bags having an inner and outer sack, which is particularly suitable for the dust-free emptying of bulk bags filled with moisture-sensitive, toxic or corrosive fluid bulk materials. The invention also relates to a method for emptying bulk bags using the emptying device according to the invention.

It is known to market fluid bulk materials in large sack-like containers referred to in the following as bulk bags. Bulk bags for receiving corrosive, toxic and/or otherwise sensitive, possibly hygroscopic, bulk materials usually comprise a sealing-tight inner sack, also called an inliner, and a mechanically stable outer sack. The inner sack is usually made of a sufficiently thick film of plastics material or a compound film, for example a plastics material film coated with aluminum. The outer sack is generally made of a natural or synthetic textile material, often a ribbon woven. In their upper region, bulk bags with an inner and outer sack usually comprise a closable filling aperture, which is also used for ventilation during emptying, and carrying loops which allow for handling using lifting tools. Arranged at the base of the bulk bag are the outlet necks, which are fitted within one another and are closed by means of a lower and an upper sack tie, which generally enclose both sacks.

In addition, the outlet neck of the inner sack is welded in a sealing-tight manner, usually beneath the lower sack tie. The tied and/or welded outlet neck of the inner sack can be folded in a suitable manner and arranged within the outlet neck of the outer sack.

In order to empty the bulk bags, the latter are brought over the container which is to be filled by means of the handling tools and are emptied after opening the sack ties. Dust-free emptying of bulk bags is not possible in this manner. For dust-free emptying of bulk bags, various emptying devices have become known in the art.

EP-A 0 637 552 teaches a metering pallet for bulk bags, a container which is open at the top being arranged beneath the opening of a receiving plate for the bulk bag, the side wall of the container comprising a device for opening and closing the container and the underside of the container being connected to a metering device. After placing the bulk bag on top of the receiving plate with the outlet neck reaching into the container, the ties can be opened through the side door in the container. If the inner sack of the bulk bag is made of a material with low flexibility, such as an aluminum-lined compound film, it is not possible to rule out disturbances in the outflow as a result of bridge formations. This is particularly a great disadvantage in cases where access to the emptying device through the side door is not possible on account of the toxic or corrosive character of the product.

A similar device is taught in GB-A 2 250 016: Apart from a receiving dish for receiving the outlet neck and the lower part of the bulk bag and a door in this dish for handling the sack ties, this emptying device also comprises a squeezing device for reducing or completely interrupting the bulk material flow and for retying the sack. This device is also unsuitable for the problem-free emptying of bulk bags, in particular those with an inner sack of low flexibility and/or a welded inner sack, since disturbances during emptying as a result of blockages in the outflow cannot always be avoided, but contact of the contents with the skin is not permissible for hygiene reasons.

It is therefore an object of the present invention to provide an emptying device for bulk bags having an inner and outer sack, by means of which said bags can be reliably emptied in a problem-free manner, without having to come into contact with the contents.

According to a further object, an emptying device is also to be provided that is suitable for emptying bulk bags having an inner sack with low flexibility, particularly for use in the case of dangerous substances.

SUMMARY OF THE INVENTION

The above and other objects are achieved by the emptying device according to the invention which is designed for use with bulk bags having an inner and outer sack. The emptying device comprises a holding device for holding the bulk bag and a container-like device, which is open at the top and is arranged substantially centrally beneath the holding device. An important feature of the invention resides in the container-like device which is constructed as a double tube device, with an inner tube and an outer tube arranged around the inner tube. The outer tube is provided with an outlet fitted to its lower edge. A closing ring is also present which can be raised and lowered in order to close the upper end of the annular gap formed by the two tubes.

BRIEF DESCRIPTION OF THE DRAWINGS

The invention and preferred embodiments as well as the function thereof will be explained in further detail with the aid of FIGS. 1 to 3, wherein.

All the drawings relate to a preferred embodiment, and in addition to the double tube device according to the invention also illustrate a gripping and pulling device.

DETAILED DESCRIPTION OF THE INVENTION

The device according to the invention is suitable for dust-free and safe emptying of bulk bags filled with dangerous substances. The device is based on a double tube container device, whose preferably funnel-shaped outlet can be connected to the product container to be filled via a fitted flexible socket or port. The emptying device comprises a holding device for the bulk bag, which is expediently constructed as a receiving dish mounted on a frame and comprising a sufficiently wide opening arranged in the center through which the sack outlet of the bulk bag can be guided. Arranged substantially centrally beneath the receiving dish is the double tube device. A preferred device also comprises a lifting/lowering device acting upon the double tube device, so that the distance between the receiving dish and the double tube device can be increased or reduced. By means of the raisable and lowerable closing ring of the double tube device, the upper end of the annular gap formed by the two tubes is closed in a sealing-tight manner. In order to empty the bulk bag, the latter is placed upon the receiving dish in such a manner that the sack outlet extends through the opening. After opening the lower sack tie, the sack outlet of the outlet necks of the inner and outer sacks fitted within one another is guided through the closing ring; the outlet neck of the inner sack is inserted after appropriate folding or crumpling into the inner tube and the outlet neck of the outer sack is inserted into the annular gap formed by the two tubes. The closing ring is then lowered in order to securely fix the outer sack and to seal the device relative to the environment. After opening the upper sack tie, the bulk bag begins to empty. In addition, it is generally expedient to lower the double tube device in order to stretch the outlet necks fitted within one another between the double tube device and the outlet dish.

A preferred embodiment of the emptying device, as is particularly suitable for emptying bulk bags having an inner sack with a low degree of flexibility since a blocking of the outlet is prevented by additional stretching of the outlet neck of the inner sack, is characterized in that it comprises at least one gripping device (21), which can be raised and lowered within the inner tube, for securing the sack outlet of the inner sack, it being possible to pull the gripping device downwards by means of a pulling device (11) operable from outside the double tube device.

Figure 1:
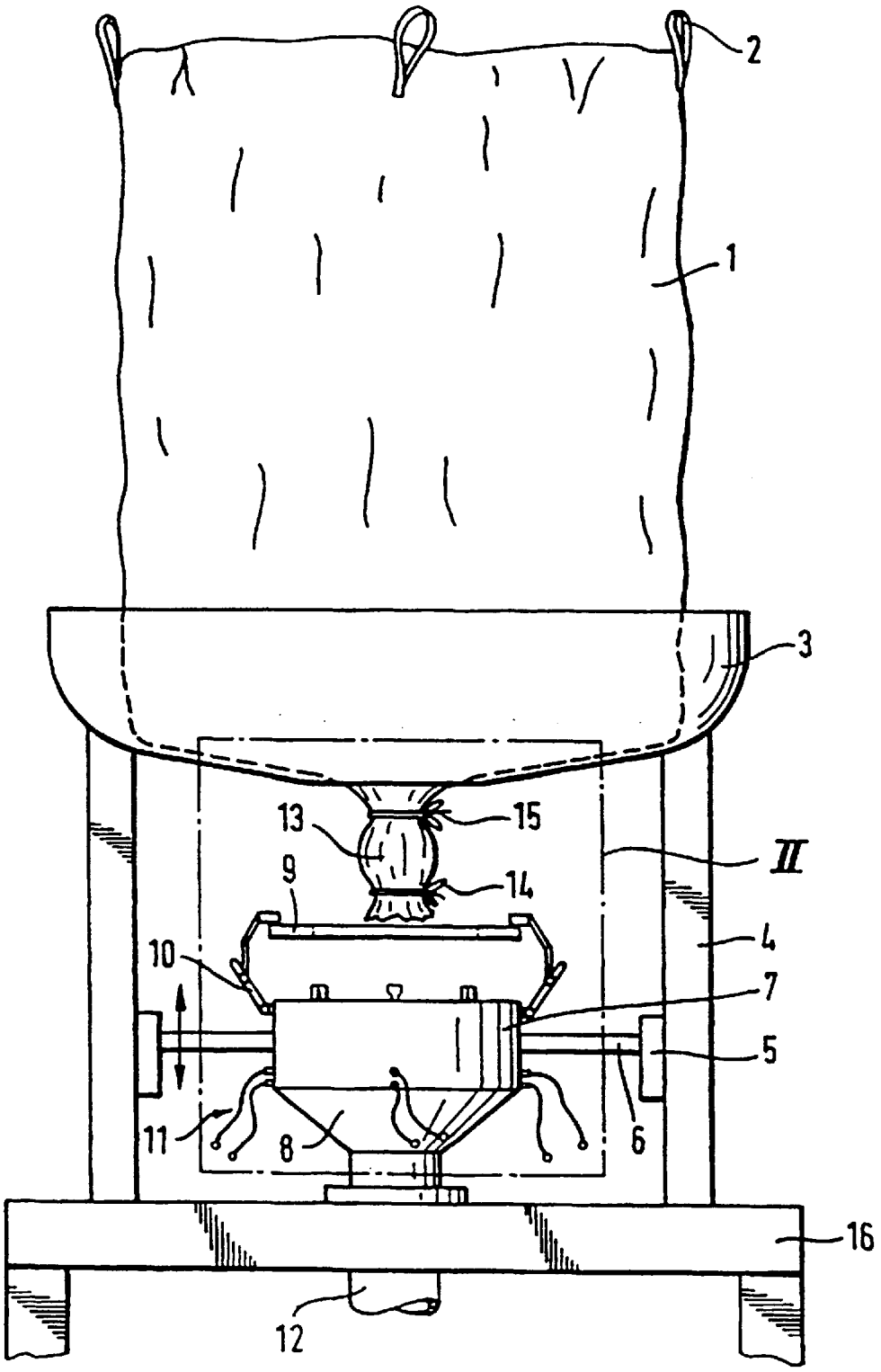
FIG. 1 is a schematic side view of a preferred emptying device according to the invention.

FIG. 1 is a schematic side view of a device for emptying packaging in the form of the large sack-like container, referred to in the following as a bulk bag which are known in the art. The bulk bag (1) comprises an inner sack accommodating the pourable substance with an outer sack arranged around the inner sack (not shown in FIG. 1, nos. 18 and 17, respectively in FIG. 2). The outlet neck (13) of the bulk bag, which comprises the outlet necks of the inner sack and the outer sack fitted within one another, is sealed and secured by a lower sack tie (14) and an upper sack tie (15). A portion of the outlet neck of the inner sack, which may be optionally additionally sealed by welding, is located in a suitably folded manner within or at the upper end of the outlet neck of the outer sack. By means of carrying loops (2) secured to the bulk bag, the bulk bag can be brought by means of a crane or a forklift truck, which can itself also fulfill the function of a holding device for the bulk bag, into a substantially central position above the double tube device of the invention.

The preferred embodiment of the holding device for the bulk bag shown in FIG. 1 is a receiving device mounted on a support frame (4), more particularly a receiving dish (3) with a centrally disposed opening, through which the sack outlet neck (13) is guided. The double tube device is arranged centrally beneath the opening of the receiving device, namely at such a distance that the outlet neck of the bulk bag extends into the double tube device. The emptying device expediently comprises a lifting/lowering device (5), so that the double tube device secured thereto by means of holding elements (6) can be raised and lowered. The lifting/lowering device (5) only schematically illustrated in FIG. 1 can, as shown, act upon the support frame (4) or a holding element secured separately to the receiving dish.

According to a further embodiment, it is possible to equip the receiving device for the bulk bag with a lifting/lowering device instead of the double tube device; however, it is preferable for the double tube device to be equipped with the lifting/lowering device. The lifting/lowering device can be constructed in any desired manner and can be mechanically, pneumatically or electrically actuated. The lifting/lowering device is especially preferably based on a combination of a spring and a manually actuated lifting device, it being possible to lower the double tube device by compressing the spring by means of the lifting device. The double tube device usually rests upon two oppositely disposed holding elements, each on a lifting/lowering device.

Of the double tube device itself, in FIG. 1 shows the outer tube (7), the outlet (8) which is fitted to the lower edge and is funnel-shaped in this case, a pipe socket or port: (12) which is fitted to the outlet funnel and through which the bulk material is supplied directly or via a metering device to the container to be filled. Further component parts of the double tube device are the closing ring (9), which can be lowered onto the double tube and raised again by means of one or more lifting/lowering devices, constructed as closing braces (10) in FIG. 1, and one or more gripping devices (21), which are an essential feature of the invention, with associated pulling devices (11). In FIG. 1, the emptying device rests upon a receiving platform (16).

Figure 2:
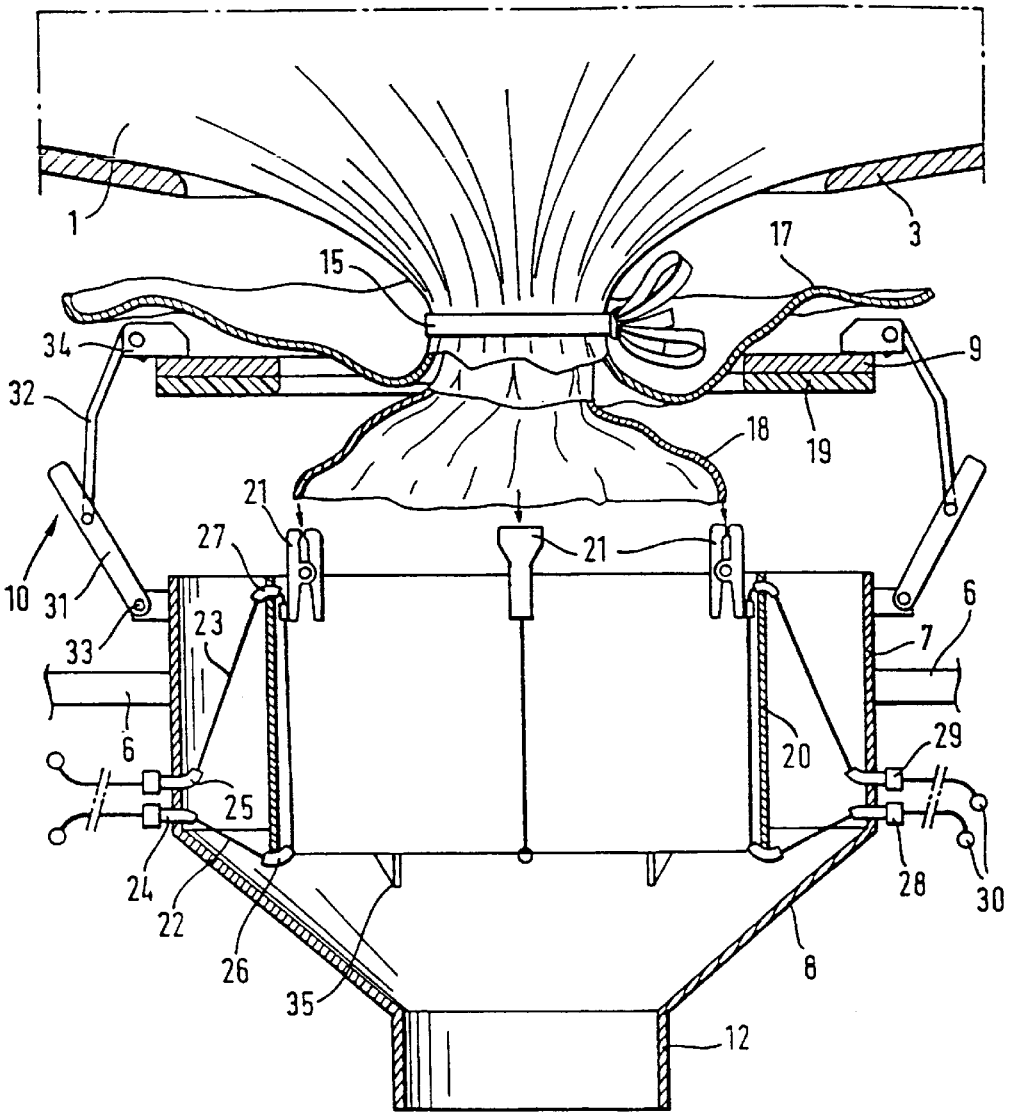
FIG. 2 is an enlarged sectional detail according to the area II in FIG. 1.

In the enlarged detail drawing of FIG. 2, details of the double tube device and the gripping and pulling device which is particularly expedient for emptying bulk bags having an inner sack with low flexibility are shown. The inner tube (20) is disposed centrally within the outer tube (7). Fitted to the bottom edge of the outer tube is an outlet funnel (8) and an outlet port (12) is in turn fitted to the outlet funnel. The inner tube is secured by means of one or more securing means (35) to the lower part of the outer tube or the upper part of the adjoining outlet; the annular gap formed between the inner and outer tubes should remain essentially free in order to receive the end portion of the sack outlet of the outer sack. The holding elements (6) acting upon the outer tube and leading to the lifting/lowering device—not illustrated in FIG. 2—for the double tube is schematically illustrated.

Figure 3:
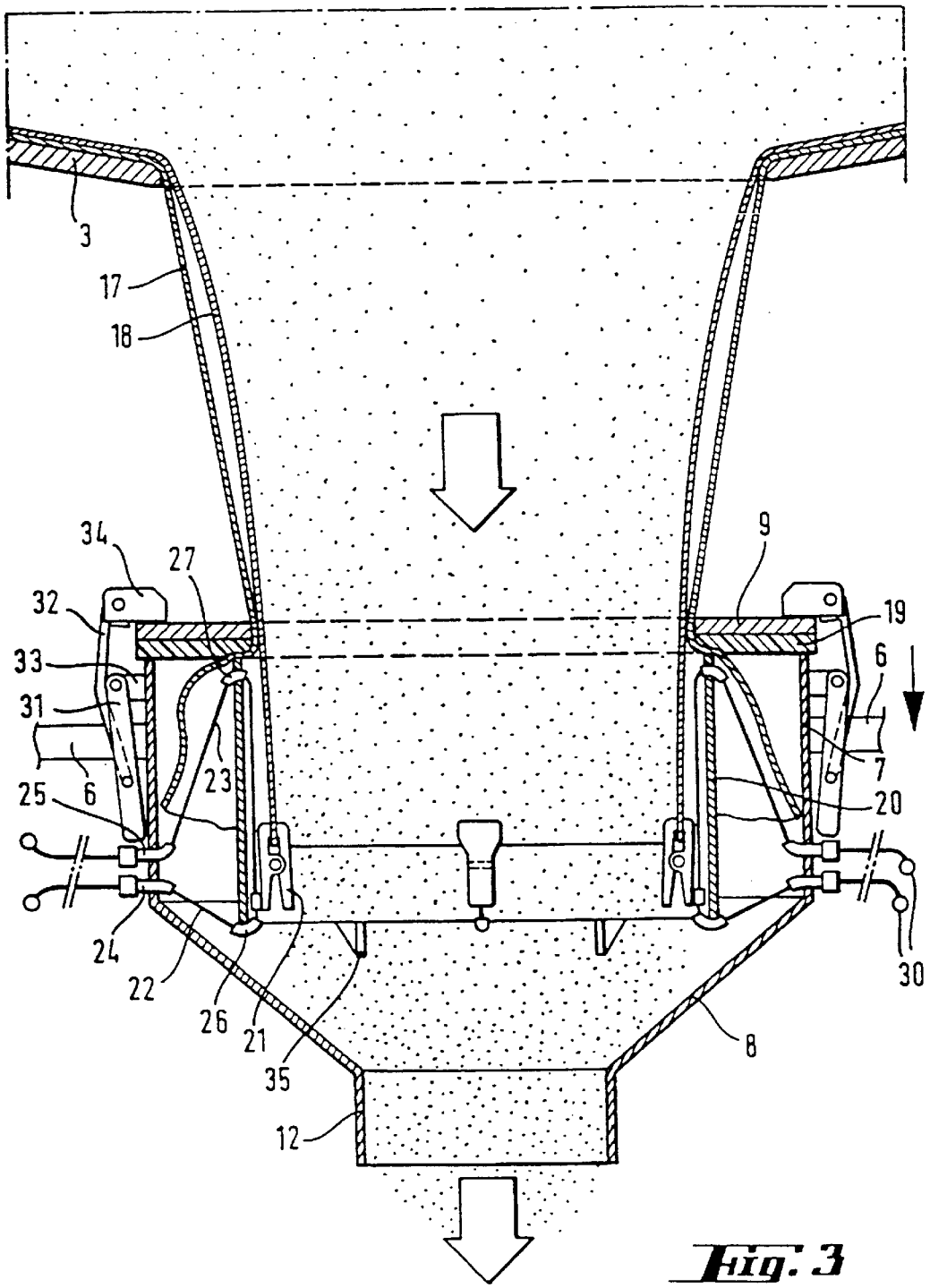
FIG. 3 is a view similar to FIG. 2 in a different operating position.

The closing ring (9), which is shown in its open position, is provided on its underside with a sealing ring (19). The lifting/lowering device (10) for the closing ring—FIG. 2 shows two devices of this type arranged opposite one another—is constructed in FIG. 2 in the form of closing braces: The closing lever (31) acts at one end upon a lever mount with a hinge joint (33), and at the other end via a hinge joint upon a closing bracket (32), which is in turn pivotably secured via a hinge joint to the bracket mount (34) fixed to the closing ring. Two closing braces are illustrated in FIGS. 2 and 3 respectively, although it can be expedient to arrange three or four closing braces symmetrically around the outer tube. The width of the closing ring is dimensioned in such a manner that the annular gap formed between the inner and outer tubes can be completely covered.

In the preferred embodiment according to FIG. 2, three gripping devices (21) constructed as clamps are shown. In the preferred embodiment of FIGS. 2 and 3, the pulling device (11) comprises a lower cable line (22) acting upon the gripping device, an upper cable line (23) also acting upon the gripping device, guide elements (26) for deflecting the lower cable line under the lower edge of the inner tube, guide elements (27) for guiding the upper cable line through the wall of the inner tube, a sleeve (24 and 25) in each case for guiding the lower and upper cable lines through the wall of the outer tube, a seal (28 and 29) in each case for the lower and upper cable lines and a handle (30) for each cable line. The cable line sleeves (24 and 25) are arranged in the lower part of the outer tube, so that the upper cable line extending in the annular gap does not impede the reception of the end portion of the sack neck of the outer sack.

In the operative position illustrated in FIG. 2, the sack outlet neck with the upper sack tie (15) is disposed within the opening of the opened closing ring. While the end portion of the outlet neck of the inner sack (18) is shown ready for securing by the gripping devices, the end portion of the outlet neck of the outer sack is shown still outside the closing ring for the sake of clarity in the drawing.

FIG. 3 illustrates the "emptying" operating position, namely, the end portion of the outlet neck of the outer sack lying in the annular gap and being secured by means of the lowered closing plate. The end portion of the outlet neck of the inner sack, whose edge is grasped by the gripping devices, is disposed in a stretched position within the inner tube. The sack is expediently secured by the gripping devices in the region of seams or reinforcements. The stretching of the outlet neck is effected on the one hand by pulling down the gripping devices and on the other hand by lowering the entire double tube device. In FIG. 3, the distance between the double tube device and the receiving dish is increased by the lowering as compared to the distance in FIG. 2.

The gripping device (21) and pulling device (11) illustrated in FIGS. 2 and 3 and comprising components (22 to 30) constitute a highly effective design which can be simply but reliably handled in spite of the use of extremely simple technical means. Of course, both the gripping device and the pulling device can be designed differently, although this involves an increase in technical outlay and therefore in the cost of the emptying device, without any significant additional advantages being gained.

The emptying of a bulk bag with an inner sack of low flexibility using the emptying device according to the invention comprises the following steps:

1. Securing of the bulk bag by means of a holding device. In principle, the function of the holding device can also be fulfilled by suspension from a crane or forklift truck. However, it is substantially more expedient to place the bulk bag on a holding device with an opening arranged in the center, the outlet neck being guided through the opening.
2. opening of the lower sack tie and release of the outlet of the inner sack. Guidance of the outlet necks of the inner and outer sacks fitted within one another through the opened closing ring. Severance of a welding seam in cases where the inner sack is welded.
3. Fixing of the gripping devices to the edge of the outlet of the inner sack and stretching of the outlet neck by actuating the pulling device. Introduction of the outlet neck of the outer sack into the annular gap and fixing of the outlet neck of the outer sack by lowering the closing ring.
4. opening of the upper sack tie, so that emptying begins and lowering of the double tube device. If necessary, the pulling device can be re-actuated in order to keep the outlet neck of the inner sack taut.

The device according to the invention and the emptying method using this device are characterized by a high degree of simplicity and safe handling. The emptying of the bulk bag is effected in an entirely dust-free manner and the operator does not come into contact with the contents. By using the gripping and pulling device, it is also possible to reliably stretch outlet necks of inner sacks having low flexibility and to avoid disturbances during the emptying of the bulk bag.

Further variations and modifications of the foregoing will be apparent to those skilled in the art and are intended to be encompassed by the claims appended hereto.

German priority application 196 41 982.4 is relied on and incorporated herein by reference.

We claim:

1. An emptying device for a bulk bag having an inner and outer sack, comprising a holding device for the bulk bag and a container-like device open at the top which is arranged substantially centrally beneath the holding device, wherein the container-like device is constructed as a double tube device, having an inner tube, an outer tube arranged around the inner tube thereby forming an annular gap between said inner and said outer tube, an outlet fitted to a lower edge of said outer tube, and a raisable and lowerable closing device for closing an upper end of the annular gap formed by the two tubes.

2. The emptying device according to claim 1, further comprising at least one gripping device for securing a sack outlet of an inner sack, which gripping device can be raised and lowered within the inner tube and can be pulled downwards by means of a pulling device operable from outside the double tube device.

3. The emptying device according to claim 2, wherein the holding device is mounted on a support frame.

4. The emptying device according to claim 2, wherein said holding device is a receiving dish with a centrally arranged opening through which the sack outlet neck is guided.

5. The emptying device according to claim 2, wherein the double tube device is mounted on the receiving device or support frame so as to be raisable and lowerable by means of one or more lifting/lowering devices.

6. The emptying device according to claim 2, additionally comprising two to four gripping devices, with pulling devices associated with the gripping devices each comprise an upper and lower cable line acting upon the gripping device, the cable lines being guided out of the double tube device by guide elements in such a manner that the gripping device can be moved downwards by pulling the lower cable line and upwards by pulling the upper cable line.

7. The emptying device according to claim 6, wherein the gripping devices are clamps.

8. The emptying device according to claim 6, wherein the upper cable line is guided through the wall of the inner tube in the upper section of the inner tube and the lower cable line is guided through said wall or beneath the lower edge thereof in the lower section, and both cable lines are guided out of the double tube device in the lower section of the outer tube or at the fitted outlet.

9. The emptying device according to claim 1, wherein the holding device is mounted on a support frame.

10. The emptying device according to claim 1, wherein said holding device is a receiving dish with a centrally arranged opening through which the sack outlet neck is guided.

11. The emptying device according to claim 1, wherein the double tube device is mounted on the receiving device or support frame so as to be raisable and lowerable by means of one or more lifting/lowering devices.

12. The emptying device according to claim 1, further comprising a closing ring that can be lowered in order to close said annular gap by means of one or more lever devices acting upon the outer tube and closing ring.

13. The emptying device according to claim 12, wherein said lever devices are closing braces.

14. The emptying device according to claim 1, wherein the outlet is funnel-shaped.

15. The emptying device according to claim 14, wherein the outlet is fitted with an outlet port.

16. A method for emptying a bulk bag having an inner and outer sack, comprising the steps:

securing a bulk bag by means of a holding device;

opening of a lower sack tie and releasing an outlet of said inner sack;

guiding outlet necks fitted within one another through the central opening of a closing ring, removing any welding which may be present on the inner sack;

fixing gripping device to an edge of the outlet of the inner sack;

introducing the outlet neck of the outer sack into the annular gap between the inner and outer tubes;

lowering the closing ring in order to secure the outlet edge of the outer sack;

stretching the outlet edge of the inner sack by pulling down the gripping device;

opening the upper sack tie; and lowering the double tube device in order to stretch the outlet neck of the inner and outer sack.

* * * * *